United States Patent [19]

O'Neal et al.

[11] 3,977,357

[45] Aug. 31, 1976

[54] VOTING MACHINE

[75] Inventors: Cothburn M. O'Neal, Dallas; Alfred M. Mayo, Richardson, both of Tex.; George William Childs, deceased, late of Dallas, Tex., by Patricia M. Childs, executrix

[73] Assignee: Riverside Press, Inc., Dallas, Tex.

[22] Filed: May 28, 1974

[21] Appl. No.: 473,920

Related U.S. Application Data

[62] Division of Ser. No. 309,174, Nov. 24, 1972, Pat. No. 3,866,826.

[52] U.S. Cl. ..... 116/124 R; 200/333; 250/465

[51] Int. Cl.[2] ..... G09F 9/00; H01H 13/04

[58] Field of Search ..... 116/114 R, 124 L, 124 R, 116/135, 130, 172; 200/340, 314, 308, 333; 250/465, 466

[56] References Cited

UNITED STATES PATENTS

| | | | |
|---|---|---|---|
| 3,108,743 | 10/1963 | Naugle | 235/54 A |
| 3,237,591 | 3/1966 | Pichel | 116/124 R |
| 3,343,290 | 9/1967 | Madansky | 116/135 X |
| 3,366,765 | 1/1968 | Beale | 116/114 R |
| 3,451,372 | 6/1969 | Grover | 116/135 X |
| 3,538,285 | 11/1970 | Orts | 200/308 |
| 3,691,985 | 9/1972 | Otterlei | 200/314 X |
| 3,715,548 | 2/1973 | Schadow | 200/308 X |
| 3,769,482 | 10/1973 | New et al. | 116/124 L |

*Primary Examiner*—Herbert Goldstein
*Assistant Examiner*—Daniel M. Yasich
*Attorney, Agent, or Firm*—Hubbard, Thurman, Turner & Tucker

[57] ABSTRACT

A compact, versatile voting machine is disclosed having adaptability for use with various vote registering devices such as tally counters and punch card apparatus. The voting machine includes a selector mechanism having a series of parallel columns housing voter operated key slides. A vertical interlock mechanism includes ball housing blocks which are alternately disposed between the key slides and house displaceable interlock balls in a tool line. The cam blocks are adjustable to limit the effective length of the tool line to establish groupings of candidates from which a single selection can be made. A magazine at the top of each column is adjustable to permit multiple selections from a grouping. Actuation of a key cams the interlock balls into the tool line, and when a predetermined number of voter selections have been made no additional keys can be actuated as they are blocked by the tool line. A row of adjacent horizontal keys can also be interlocked to established selection groups as typically found on a general election ballot. A bar is moveable to horizontally interlock adjacent columns by introducing locking pins into a position to be cammed by actuation of a key. A drive mechanism associated with each column permits the voter to vote straight party and clears the machine to ready it for another voter. The drive mechanism includes cam controlled clutches that operate four-bar linkage elements to depress or return the key slides. A judge controlled mechanism locks the machine between voters. For various voting requirements, judge operated cam arrangements are cooperable with the horizontal locking pins and the four-bar linkage to selectively lock out partial or entire columns or rows of key slides. The key slides are provided with a voter viewable button that registers a visible, luminescent "X" when a key is voted.

8 Claims, 12 Drawing Figures

VOTING MACHINE

This is a division of application Ser. No. 309,174, filed Nov. 24, 1972.

This invention relates to voting machines and more particularly is directed to improved voting machines of the general construction described in prior U.S. Pat. Nos. 3,168,240 and 3,524,969.

A large number and variety of mechanical voting machines can be found in the prior art. Machines most commonly found in use today are of the type as shown in the U.S. Pat. No. 3,408,002 and the patents referred to therein.

These machines are generally referred to as "lever-type" voting machines and have found general acceptance and are widely used. In lever machines, multiple horizontal or vertical rows of selector levers are interconnected by cranks or similar mechanisms to counter mechanisms which register the number of votes cast for a particular candidate or issue.

Machines of this general type have a number of disadvantages. One of the foremost advantages of the lever-type machines is their extreme size and weight, often in excess of 500 pounds. Because of the weight, a single machine requires the effort of several men to transport the machine from its place of storage to the polls. Further, the large size requires an extreme amount of storage space when it is considered that a city of, for example, 1 million people may own or lease several thousand voting machines. Transportation and storage of the machines during periods of non-use can constitute a major financial burden on a governmental unit.

Aside from the above-mentioned problems of storage and transportation, the lever-type machines require complex procedures on the part of the custodian to prepare the machine for voting, particularly when the machine is to be used in primary elections. In primary elections it is common that one or more candidates will be selected by the voter from a larger group running for the office and, accordingly, the columns must be broken down into subgroups of the correct number of candidates. The subgroups are established by various interlock arrangements which usually require that grouping pins or compensators be inserted in the columns to serve as barriers to permit only a selected number of voting keys to be depressed within the column. This can be a difficult operation requiring skill and much preparation time on the part of reelection officials in order to insure proper machine functioning.

Another disadvantage of the lever-type voting machine is that the accompanying ballot is often confusing and difficult for the voter to understand because it does not duplicate the format of the traditional paper ballot. This is especially true of machines having horizontal selection rows which require a specialized ballot format to adapt to the machine. It is generally accepted practice for conventional paper ballots to display the candidates in a vertical rather than a horizontal arrangement.

It is the primary object of the present invention to provide a simple to operate, console type voting machine of substantially reduced size and weight to facilitate handling and storage. The present invention employs a very efficient, compact selector mechanism using displaceable steel balls arranged in columns which permit lists of candidates for more than one office to be placed in a single column. Further, the columns can be set so that one or more selections from that list can be made by the voter. Such an arrangement would be typically used in a primary election. The voting machine of the present invention also permits adjacent vertical columns to be mechanically interlocked so that the selection groups on the ballot can be arranged horizontally as is necessary in a general election.

The present invention further has provision for straight party, write-in, and random voting procedures and insures that the voter cannot disenfranchise himself by casting two opposing votes. The voting machine of the present invention also makes chain voting impossible. A unique clutch mechanism performs multiple functions including a clearing and locking function after each voting cycle and when a straight party selection is made.

The present invention also permits insertion of a computer compatible card into the machine on which card is recorded the voter's selections. This card may then be processed by computer to expedite computation of the election results and minimize decoding and transcription. The machine adapts to the requirements of almost any election and the ballot can be arranged in a format familiar to most voters. The buttons are depressed and the voted buttons are easily identifiable to the voter by an "X" appearing at the voted button. In summary, the present invention provides a voting machine having improved interlock systems to render the machine simple, efficient, lightweight, and yet at the same time highly versatile and applicable to a variety of voting procedures and adaptable to the various voting laws and requirements in effect in the various jurisdictions throughout the country.

These and other objects of the present invention will become apparent from the following drawings and descriptions in which.

Figure 1:
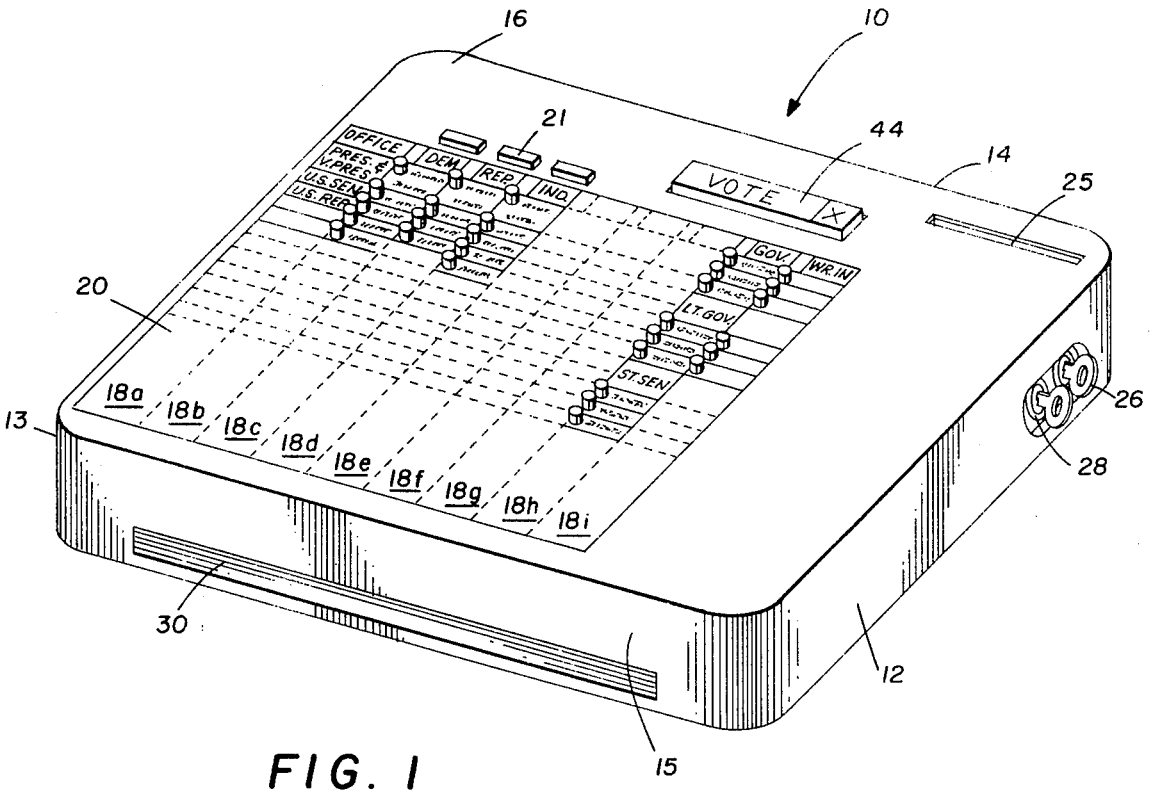
FIG. 1 is a perspective view of the voting machine of the present invention with a representative ballot in place.

The voting machine is shown in FIG. 1 and is generally designated by the numeral 10. The machine would generally be incorporated in an appropriate voting machine cabinet, not shown, when placed in use. The cabinet would provide for either a vertical or horizontal mounting of the mechanism for voter access depending on preference and voting requirements. The machine 10 generally has a basic frame structure comprising opposite side members 12 and 13 and opposite end members 14 and 15. A top panel 16 is carried by the frame structure and has provision for mounting of the ballot 20. The ballot is divided into a series of eight vertical selection columns identified **18*a* through 18*i*. It should be noted, as used throughout this description, the term "horizontal" means a plane parallel to ends 14 and 15 of the machine. The term "vertical" refers to a plane parallel to sides 12 and 13.**

Ballot 20 is not a typical ballot one would find when voting but rather is a representative ballot to illustrate the operation of the machine. Left hand columns 18*a*, 18*b*, 18*c* and 18*d* are set up in a format corresponding to that used in most general and some city elections in which several political parties offer candidates for the same offices as are listed in column 18*a*. As shown, the voter would make a choice for the office of president from either columns 18*b*, 18*c*, or 18*d* and, once having voted one of the selections, is not permitted by the interlock system of the present invention to make another selection for that office. Column 18*h* illustrates a typical primary election ballot wherein one selection is chosen from several candidates to be the particular party's candidate in the general election. It will be appreciated that any other number of rows could as well be provided. At the top of each of columns 18*b* to 18*d* is a straight party button 21 which, as will be more fully explained hereafter, when depressed will cause all the voting keys in the associated vertical column to be depressed, clearing all other buttons on the machine. A slot 25 in the upper right hand of the machine is provided to accept a data processing card which is punched in response to the voting operation. A resetting lock 26 is used to lock or release the mechanism after each vote is recorded preparing the machine for the next voter. Lock 28 operates the column lock-outs to lock out of operation certain selected columns or partial columns. The keys for lock 26 and 28 are retained by the election judge or official on duty at the election location. When the voter has completed making selections, main vote button 44 initiates the machine through its operative cycle. A tray 30 accessible through front 15 contains the tally counters and a public counter. One tally counter is provided to correspond to each of the voting buttons on the machine. For a more complete description and understanding of the operation of the candidate counters and the card insert and card punching mechanism, please refer to commonly assigned co-pending application entitled "Punch Assembly and Method of Making Same", U.S. Ser. No. 309,192, now abandoned, and commonly assigned U.S. Pat. No. 3,821,522, granted June 28, 1974, entitled "Counter," both filed concurrently herewith.

Figure 2:
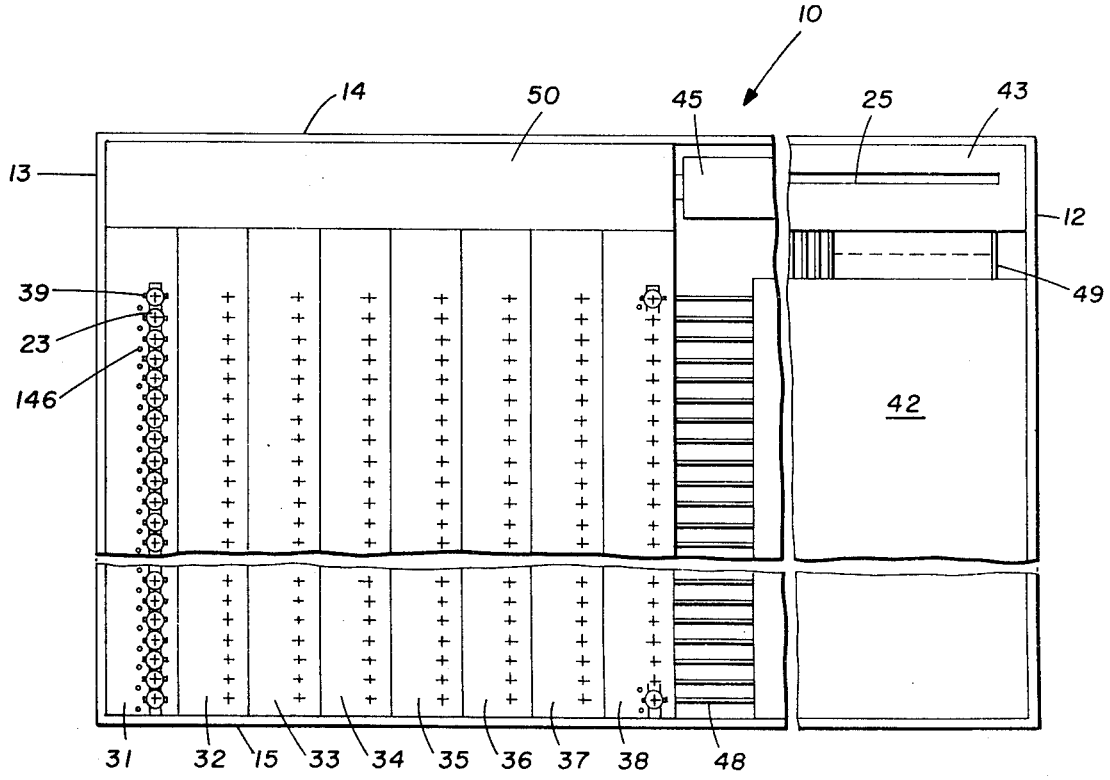
FIG. 2 is a front view of the voting machine with the ballot removed.
Figure 3:
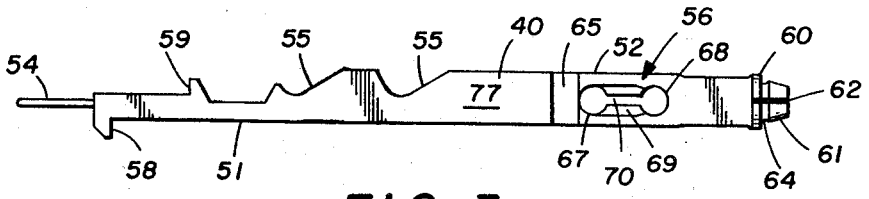
FIGS. 3, 4 and 5 are elevational views of a voting key.
Figure 4:
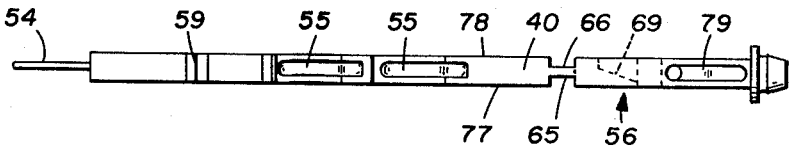
Figure 5:
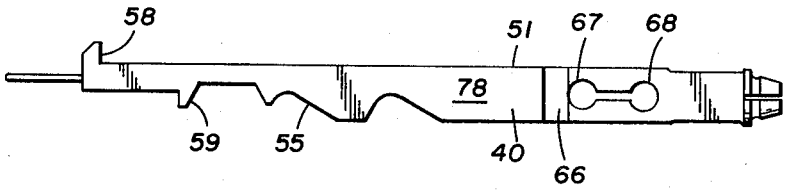

FIG. 2 illustrates a machine of the present invention with the ballot 20 and cover plate 16 removed to expose the basic components of the machine. The rectangularly arranged frame members 12, 13, 14, and 15 support eight vertical column members 31 through 38. Each of the columns 31 to 38 are similar in construction and each is generally elongate and provided with a vertical row of slots 39 therein which slidably receive the end key slides 40. Slot 146 provides access to a cam device for setting up vertical selection subcolumns. The details of the key slides are shown in FIGS. 3 through 6 and are discussed in the following paragraphs. The purpose of the present brief description is to outline the interaction of the main components so that the operation of the voting machine will be more easily understood. To make a selection, key slides 40 are manually depressable through a voting button 23 extending through the panel 16 and ballot 20. Tray 30 containing the tally counters is horizontally positioned subjacent columns 31 to 38 and depression of a key slide 40 will engage a corresponding counter in the tray 30 through plunger 54 at the terminal end of slide 40. The counters may be of the well known star wheel type or similar to those disclosed in the co-pending application referenced above.

Also operatively engaging each of the key slides is a rod 48 which extends transversely of the columns and is received in punch bank selector 42. Rods 48 are horizontally displaced to the right by actuation of the corresponding key slide by cam surfaces 55 on the slides 40. Rightward movement of a transverse bar 48 into the punch bank selector 42 will block a corresponding punch selector bar 49 so that upon actuation of the voting cycle by main voting button 44, the card inserted in slot 25 of card punching mechanism 43 will be perforated in a pattern corresponding to the voter's choice. Clearing of the machine and actuation of the straight party cycle is by virtue of the multiple clutch drive mechanism 50 shown at the upper portion of the machine. An electric motor 45 powers the mechanism through the clearing and straight party cycles as will be explained. Provision can be included for manually driving the machine by a crank in case of a power failure.

The foregoing is just a brief description of the various main components to the machine so that their relative location and interrelationship may be appreciated. The operation and mechanism of the counter assembly and the punch mechanism form no part of the present invention but rather are the subject of the separate aforementioned patent applications. The present invention concerns itself with the voter selection mechanism and more particularly with the interlock arrangement for setting up and limiting voting selections and the clutch-drive mechanism for clearing the machine and for voting a straight party ticket.

Referring now to FIGS. 3 through 6, the voting key slide 40 is shown in detail. The key slide 40 comprises an essential part of the machine which is operative to register the voter's selections. Key 40 extends laterally in slots 39 in each of the columns and each is manually depressable through button 23 by the voter. Each key 40 includes an upper generally rectangular shank portion 52 and a lower extension 51 having opposite sides 77 and 78. Opposite transverse slots 65 and 66 extend across the intermediate portion of the key 40. Angular cam surfaces 55 are provided on one edge of the key. The cam surface 55 on each slide is associated with the end of transverse punch actuator bars 48. The longitudinal position of cam surfaces 55 along extension 51 varies with the column in which the key slide 40 is located. For example, cam surfaces 55 on the key slides located in column 38 are immediately adjacent the shank 52 and the location of the corresponding cam surfaces 55 is displaced downwardly for the slides in each leftwardly successive row. In this way, all rods 48 that are associated with the keys in a horizontal row of key slides are in vertical alignment beneath the columns. The rods 48 are configured to avoid interference with the adjacent key slides.

Inward of the lower end of the key 40 a shoulder 59 projects laterally. Shoulder 59 is adapted to be engaged by a clear bar of the drive mechanism 50 to return the key to a non-actuated position. Extending from the opposite side of the key is projection 58 which is adapted to be engaged by a bar in drive 50 to pull the associated key 40 downwardly when a straight party button 21 is actuated on the machine. The clear and straight party mechanism is actuated by drive mechanism 50, as will later be explained.

An important feature of this invention is the vertical interlock arrangement which limits the number of voting buttons a voter can depress within a column by blocking the remaining slides when the predetermined number of selections has been made. The vertical interlock is achieved by camming accurate steel balls in a tool line extending through the columns along a cam surface on the keys 40. Each key is provided with cam means 56 including adjacent circular bores 67 and 68 extending through the shank of the key slide. A semicircular camming surface 69 extends approximately at a 30° angle from the edge of hole 67 at surface 77 toward the edge of bore 68 at surface 78. Axial slot 70 extends between bores 68 and 69 through the intermediate cam surface 69.

Figure 6:
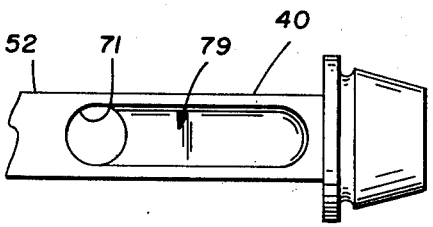
FIGS. 6 and 7 are enlarged detail views of the end of the voting key.
Figure 7:
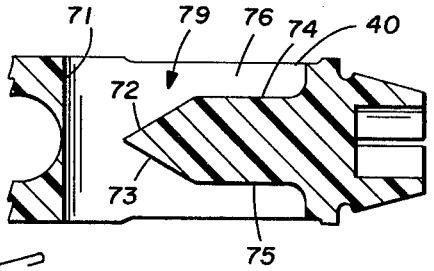

The vertical interlock mechanism permits the election official to set up the machine in vertical selection column as, for example, would be necessary in a primary election. Other elections may require that the machine be programmed horizontally as in a general election. Accordingly, an important feature of the present invention includes means to selectively interlock adjacent horizontal keys to define a selection group and so that only one key can be voted within the group. As best seen in FIGS. 6 and 7, a cam 79 is provided on the upper end of the slide 40 in opposite sides which cooperate with horizontal locking pins to prevent actuation of more than one key within a group. The cam means include bore 71 that extends transversely through the shank portion 52 of the plunger slide 40. Cam 79 includes generally V-shaped surfaces 72 and 73 which intersect bore 71 at the longitudinal centerline of the shank portion. As best seen in FIG. 7, surfaces 72 and 73 diverge outwardly to oppositely arranged lands 74 and 75, respectively, which are all commonly defined within recess 76 in the opposite edges of the key 40.

FIGS. 9 to 11 and 16 to 18 best show the relationship of the slides 40 in the columns. Keys 40 are all received in adjacent vertical columns 31 to 38 aligned vertically and horizontally. Each column contains a selected number of keys. The following description is with reference to column 33 which is typical. Column 33 is a generally elongated rectangular section and has an aligned series of slots 82 which receive the main body portion of keys 40. Enlarged slots 39 aligned with slots 82 extend to the surface of the column. A shoulder 84 at the bottom end of each slot 39 serves as a stop to engage outwardly extending flange portion 60 of the associated key. Thus, looking at FIG. 11, which is a sectional view through a portion of adjacent columns, key 40 is shown in a normal unactuated position; when actuated it will be moved inwardly until flange 60 contacts shoulder 84 at the bottom of slot 39. An over center toggle pin, not shown, may be associated with each key slide 40 to give the key a positive action. Cross bore 85, approximately corresponding in diameter to the cross bore 71 in the shank portion of key slide 40, intersects column slot 82 and terminates in rectangular slot 86 which extends longitudinally in column 33. Horizontal interlock bar 90 is slidable in slot 86. Another longitudinal channel 91 extends the length of column 33 perpendicular to the axis of key slide 40 and intercepts slot 82 and houses vertical interlock ball housing blocks 110 which, as will be described later, are interposed between and cooperate with vertically adjacent keys 40 in the vertical interlock mechanism.

Figure 8A:
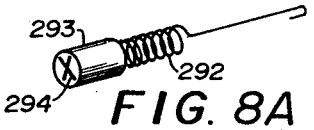
FIG. 8A is a perspective view of the button shown in FIG. 8.
Figure 8:
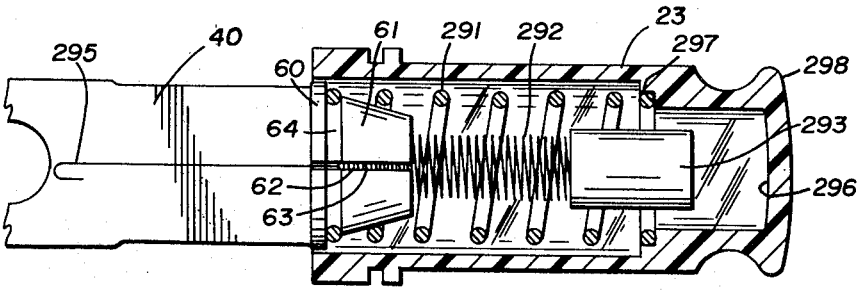
FIG. 8 is an enlarged detail view of the voting key and associated button.
Figure 9:
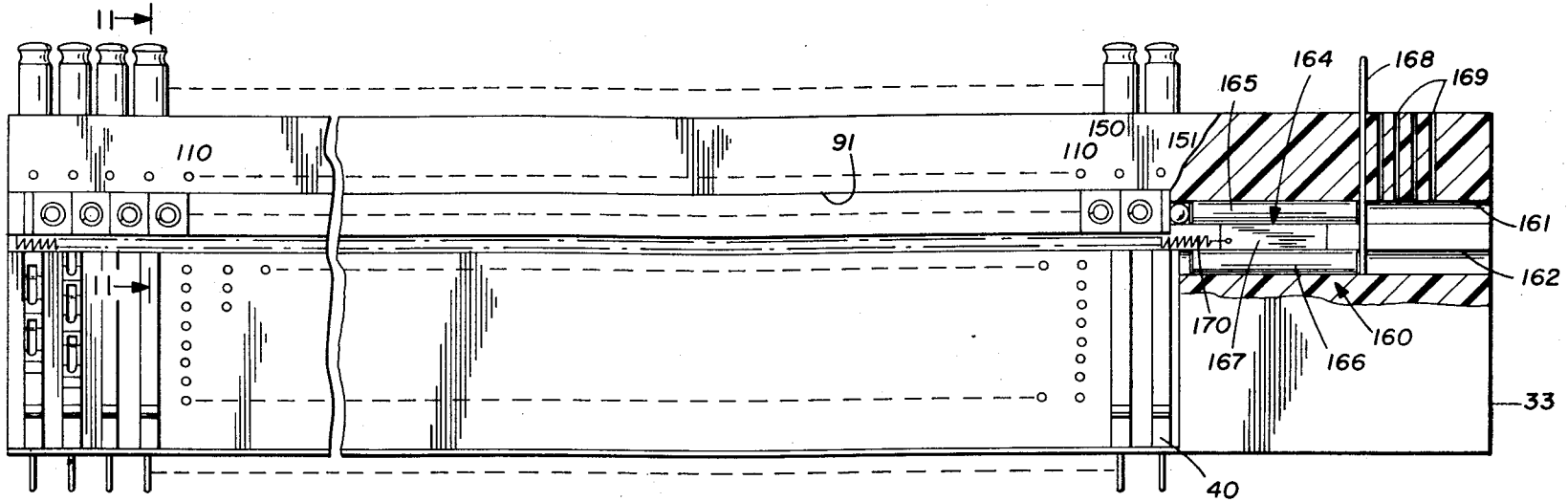
FIGS. 9 and 10 are opposite side elevational views of the individual voting machine columns, FIG. 10 being inverted.
Figure 10:
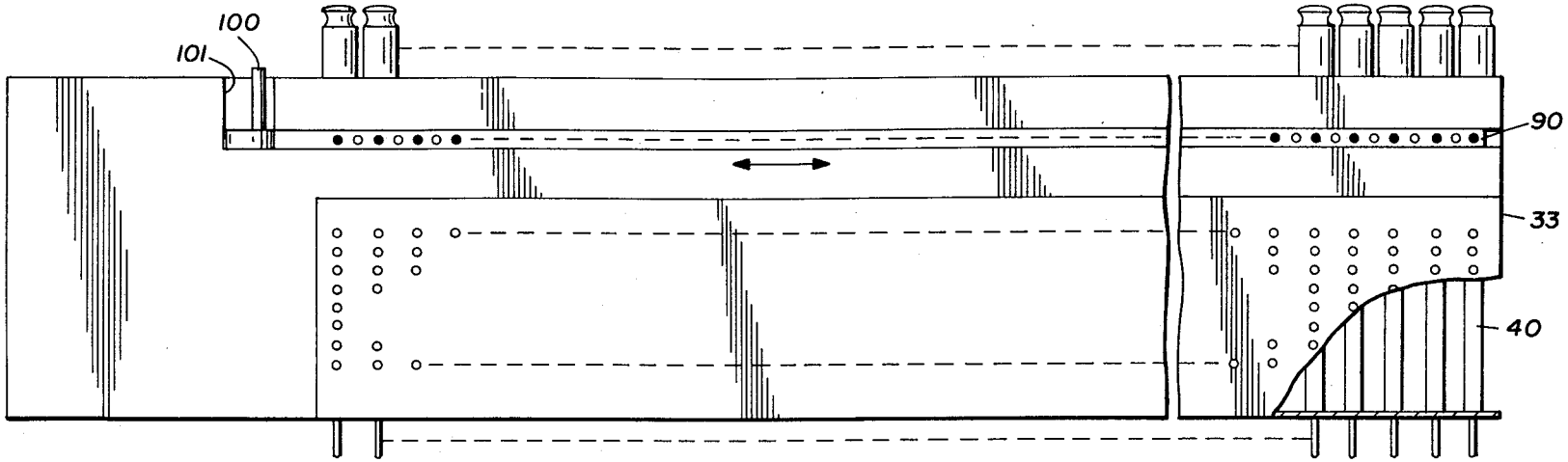
Figure 11:
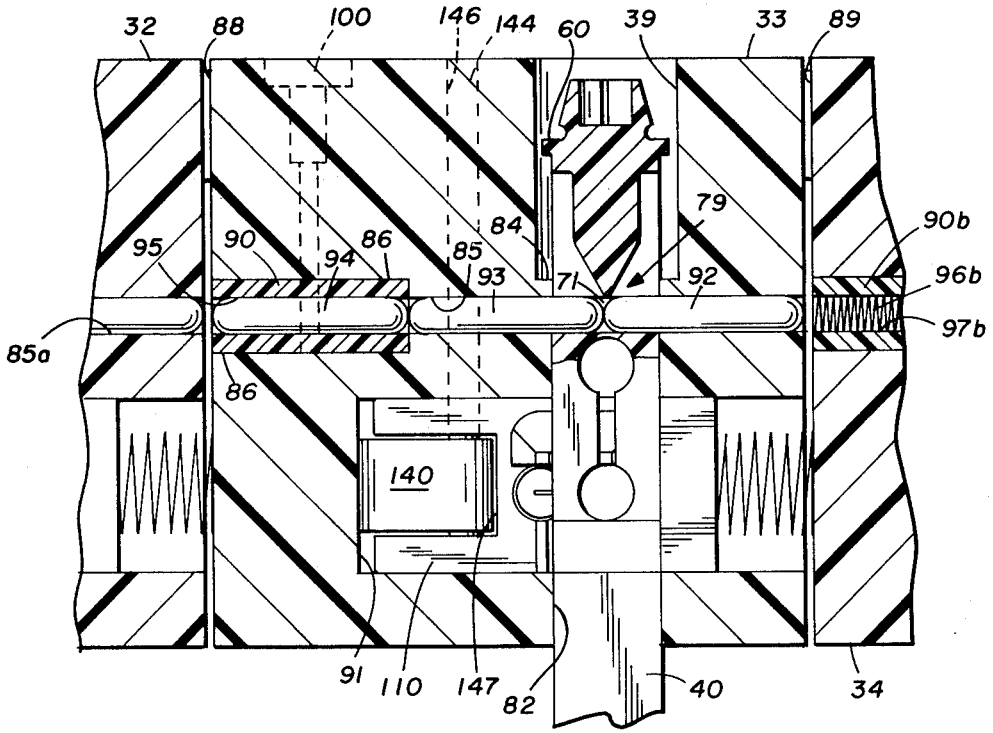
FIG. 11 is an enlarged partial sectional view taken along lines 11—11 of FIG. 9.

Another unique feature of the present invention allows a voter to easily determine which voting he has previously selected. This is accomplished by a luminescent "X" becoming visible in the top of the voting button when the voting button is depressed. Referring to FIG. 8, it will be seen that the outer end of voting key 40 is provided with a circular flange 60 and a projecting conical section 61. Annular groove 64 extends around the base of conical section 61 adjacent flange 60. Concentric blind bore 289 extends in the outer end of conical section 61. Diametral slot 63 extends axially along conical section 61. The outer end of slide 40 is capped by vote button 23 which is generally cylindrical shaped having its inner open end surrounding flange 60 of slide 40. A compression coil spring 291 is engaged in annular slot 61 and extends circumferentially along the interior of vote button 23 and is engaged with interior shoulder 297 of vote button 23. When vote button 23 is pushed, the force will be transferred to the flange 60 of slide 40 causing slide 40 to correspondingly be depressed. Spring 291 serves to give some resiliency to the voting operation and also serves to protect the voting machine by absorbing any shock that may be imposed on the voting button by unusual voting tactics resulting from voter frustration and anger. A smaller coil spring 292 extends axially within vote button 23 and seats on the bottom of blind bore 289. Spring 292 terminates short of the end of button 23 and is provided on its outer end with a small cylindrical member 293. Member 293 is provided with an "X" indicator 294 on its outer surface. Member 293 is preferably of a bright luminescent color having light gathering characteristics. In this way no special lighted or external illumination is needed for the voting button. This eliminates expensive and complicated electrical circuitry. A retainer 295 extends from the lower end of coil spring 292 in slot 63 along the shank of voting key slide 40. With voting key slide 40a in a position in a voting column, retainer wire 295 is secured to shoulder 84 in bore 39 of the column. Similarly, the exterior surface of vote button 23 is snugly fit within bore 39 in the column. Button 23 is transparent and is preferably of a clear plastic material having end surface 298 frosted to diffuse light passing through. Thus it will be seen that when the vote button is in a nonactuated position, member 293 is positioned away from the inner end 296 of vote button 23. The "X" on the end of member 293 is thus not visible to the voter as the light is diffused at surface 298. When a voter depresses button 23, relative movement between button 23 and member 293 will occur causing end 296 to come into close contact with the end of member 293. The light diffusion is reduced on the "X" on the outer end of member 293 highly visible to the voter through the end surface 298 of the vote button. The luminescent color of member 293 further improves the visibility of the "X" on the voted buttons. Thus, the voter can easily visually determine which button he has selected by simply locating those buttons on which the "X" is visible. Also, as a further indication to the voter, the physical displacement or depression of the button serves to indicate a voted selection.

Thus, the present invention provides a compact mechanically operated voting machine which records each voter's choice simultaneously on mechanical counters and on conventional data cards for computer completion. The voting panel is arranged similar to a conventional paper ballot providing space for candidates and issues. Vertical and horizontal interlock devices provide almost an infinite number of voting arrangements including straight ticket, split ticket, and selective voting in accordance with the requirements of almost any election or jurisdiction. Lockout devices insure the integrity and security of the voting operation. It will be noted that no one person can alter the election judge since such would require the concerted action of the judge operating the key locks, the person responsible for the tally counting, as well as tampering with the computer checked results. Such concert of action would be easily detected and therefore is not likely, adding to the security of the system. The straight party mechanism permits the voter to choose to vote a straight party ticket with ease and accuracy. It will be noted that the machine was described as being powered in the drive system by an electric motor. It will be obvious to those skilled in the art that the main drive system can be operated by means of a hand crank, for example, mechanically connected at gears 191. With this option, the voting machine of the present invention is totally mechanical permitting voting operations to be effectively carried on during periods when electric power is not available or if electric service is interrupted.

Although preferred embodiments of the invention have been described in detail, it is to be understood that various changes, substitutions, and alterations can be made therein without departing from the spirit and scope of the invention as defined by the appended claims.

What is claimed is:

1. A selector for a voting machine comprising:

a depressible key member having an annular groove adjacent its outer end and defining a spring seat at its outer end;

a generally cylindrical button member associated with said key member and adapted to actuate said key member to depress same, said button member having a hollow interior with a generally transparent viewable light-diffusing end portion;

indicator means housed within said hollow interior having indicia means on a surface exposed to the interior side of said viewable end portion, said surface having light gathering characteristics;

first spring means extending between said indicator means and said spring seat for supporting said indicator means, including retainer means securing said indicator means against movement as said key and button members are depressed whereby said indicia means are spaced apart from the interior side of said end portion in a key member non-actuated position far enough to not be viewable through said light-diffusing end portion, and said indicia means are positioned in close proximity therewith in a key member actuated position so as to be viewable through said light-diffusing end portion; and second spring means extending between said button member and said annular groove, whereby depression of said button member will move said key and button members relative to said indicia means with said indicia means in said close proximity position clearly viewable at said viewable end portion.

2. The selector of claim 1 wherein said indicator means are provided with a luminescent surface and said indicia means comprise an "X" to indicate a voted condition.

3. A selector for a voting machine comprising:

an elongated housing having a bore therein;

a reciprocable elongated voting key slidable in said bore between a first non-voted position and a second voted position and having a generally frustoconically shaped outer end with an annular groove about said outer end and a blind bore in said outer end;

a generally cylindrically-shaped voting button connected to said outer end of said key and movable with said key between said first and second positions, said button having a hollow interior with an annular ridge therein and a generally transparent light-diffusing end portion;

a first compression spring within said hollow interior extending between said annular ridge of said button and said annular groove of said key for connecting said button to said key;

an indicator member within said hollow interior having indicia on an outer surface exposed to the interior side of said light-diffusing end portion, said outer surface having light gathering characteristics; and a second compression spring extending between said indicator member and said blind bore and having a retainer wire attached to said housing for securing said indicator member against movement relative to said housing as said key and said button move between the first and second positions, said indicia being spaced apart from the interior side of said end portion in the first non-voted position far enough to not be visible through said light-diffusing end portion, and said indicia being immediately adjacent said interior side of said end portion in the second voted position so as to be visible through said light-diffusing end portion, whereby movement of said key and said button to the second voted position causes said indicia to be clearly visible at said light-diffusing end portion.

4. A selector button comprising:

an actuable key member for selectively actuating an indicator member;

a button member having means to operatively coact with said key member and adapted to actuate said key member by movement with same, said button member having a hollow interior and a generally transparent viewable light-diffusing end portion;

indicator means housed within said hollow interior, said indicator means having indicia means on a surface exposed to the interior side of said viewable end portion, said indicia means being spaced apart from said interior side in a key member non-actuated position a distance sufficient to not be viewable through said light-diffusing end portion, and assuming a position in close proximity to said interior side in an actuated position so as to be viewable through said light-diffusing end portion; and means for securing said indicator means against movement as said key and button members move whereby as said key member is actuated by movement of said button member said indicia means is disposed in said close proximity position in view at said end portion to indicate an actuated condition.

5. The selection button of claim 4 wherein said button member is associated with said key member by a compression spring extending therebetween in said hollow interior.

6. The button of claim 5 wherein said indicia means portion has light gathering characteristics.

7. The button of claim 6 wherein said indicia means are luminescent.

8. The button of claim 4 wherein said indicator means are carried on a compression spring extending through a bore in said key member.

* * * * *

UNITED STATES PATENT AND TRADEMARK OFFICE

CERTIFICATE OF CORRECTION

PATENT NO. : 3,977,357

DATED : August 31, 1976

INVENTOR(S) : Cothburn M. O'Neal et al.

It is certified that error appears in the above-identified patent and that said Letters Patent are hereby corrected as shown below:

Column 5, line 31, cancel "plunger".

Column 6, line 38, delete "40a" and insert —40—.

Column 6, line 38, after "40 in" cancel "a".

Signed and Sealed this

*fifth* Day of *July 1977*

[SEAL]

*Attest:*

RUTH C. MASON
*Attesting Officer*

C. MARSHALL DANN
*Commissioner of Patents and Trademarks*